US006876290B2

(12) United States Patent
Yu

(10) Patent No.: US 6,876,290 B2
(45) Date of Patent: Apr. 5, 2005

(54) SWITCH STRUCTURE WITH OVERLOAD PROTECTION

(76) Inventor: Tsung-Mou Yu, No. 4, Alley 2, Lane 23, Sec. 3, Pe Te Rd., Panchiao City, Taipei Hsien (TW)

( * ) Notice: Subject to any disclaimer, the term of this patent is extended or adjusted under 35 U.S.C. 154(b) by 416 days.

(21) Appl. No.: 10/228,344

(22) Filed: Aug. 24, 2002

(65) Prior Publication Data

US 2004/0037020 A1 Feb. 26, 2004

(51) Int. Cl.[7] ..... H01H 37/52; H01H 37/02
(52) U.S. Cl. ..... 337/59; 337/56; 337/91
(58) Field of Search ..... 337/59, 56, 60, 337/68, 79, 91, 66; 200/622

(56) References Cited

U.S. PATENT DOCUMENTS 3,435,169 A * 3/1969 Wolfgang et al. ..... 200/315
3,609,268 A * 9/1971 Sanchez ..... 200/315
3,735,077 A * 5/1973 Ohashi ..... 200/315
3,928,743 A * 12/1975 Ohashi ..... 200/308
3,989,915 A * 11/1976 Nishikawa ..... 200/437
4,013,857 A * 3/1977 Tanaka ..... 200/315
4,115,673 A * 9/1978 Smith ..... 200/315
4,337,450 A * 6/1982 Matthies ..... 337/66
4,345,233 A * 8/1982 Matthies ..... 337/75
4,736,081 A * 4/1988 Sorrells ..... 200/525
4,904,833 A * 2/1990 Sato et al. ..... 200/557
5,265,716 A * 11/1993 Sawada et al. ..... 200/5 R
5,453,725 A * 9/1995 You et al. ..... 337/68
5,541,569 A * 7/1996 Jang ..... 337/68
6,252,490 B1 * 6/2001 Lin ..... 337/79
6,275,134 B1 * 8/2001 Chen ..... 337/37
6,570,480 B1 * 5/2003 Huang ..... 337/79
6,664,884 B1 * 12/2003 Yu ..... 337/59
6,674,033 B1 * 1/2004 Wang ..... 200/334
6,674,034 B1 * 1/2004 Wang ..... 200/341
6,680,449 B1 * 1/2004 Wang ..... 200/334
6,734,779 B2 * 5/2004 Yu ..... 337/59

FOREIGN PATENT DOCUMENTS

CH 647094 A * 12/1984 ..... H01H/71/16

* cited by examiner

*Primary Examiner*—Anatoly Vortman

(57) ABSTRACT

A switch includes a casing and first and second conductive blades. A conductive strip made of a material that bends when subject to a temperature rise is fixed to the first blade and has a free end. A conductive plate is arranged inside the casing and in electrical connection with the second blade and movable between an engaged position where the conductive plate engages the conductive strip to form an electrical connection between the first and second blades and a disengaged position where the conductive plate disengages from the conductive strip to electrically disconnect the second blade from the first blade. When an overload occurs, an excessive current flows through the conductive strip, causing the strip to bend from a normal operation condition to a breaking condition that separates the conductive strip from the conductive plate. A link is coupled to the conductive plate and defines an elongated slot receiving the free end of the conductive strip therein. The elongated slot allows the conductive plate to move between the engaged and disengaged positions without causing movement of the conductive strip while when the conductive strip is in the breaking condition, the link drivingly couples the conductive strip to the conductive plate for returning the conductive strip back to the normal operation condition. A leaf spring is pivoted between the casing and the conductive strip to retain the conductive strip in the breaking condition until the conductive strip is driven by the link back to the normal operation condition.

19 Claims, 9 Drawing Sheets

SWITCH STRUCTURE WITH OVERLOAD PROTECTION

FIELD OF THE INVENTION

The present invention relates generally to a switch, and in particular to a switch having an overload protection mechanism for operation safety.

BACKGROUND OF THE INVENTION

A switch is operable between an ON (connected) state and an OFF (disconnected) state for control of power supply or electrical signal transmission. For a power switch, overheating and burning caused by overload resulting from undesired shorting is one of the major concerns of operation safety. Some switches available in the market are provided with safety mechanism that automatically cuts off power supplied therethrough in order to eliminate the potential risk of overheating and burning. Such switches, however, have complicated structures, making costs high and manufacture difficult.

Another concern of the safety mechanism of the power switch is the operation reliability thereof. Operation reliability of a safety mechanism may deteriorate due to aging of the parts thereof. Such reliability problem often causes failure of timely cutting off power supplied to the switch when the switch is overloaded, leading to disasters.

It is thus desirable to have a switch structure that is simple in structure but is reliable and possesses operation safety feature.

SUMMARY OF THE INVENTION

An object of the present invention is to provide a switch having a simple structure while capable of operation safety.

Another object of the present invention is to provide a switch of low costs while having overload protection.

A further object of the present invention is to provide a switch that is easy to manufacture.

Yet a further object of the present invention is to provide a switch that is reliable in cutting off power supply therethrough in an overload condition.

To achieve the above objects, in accordance with the present invention, there is provided a switch comprising a casing and first and second conductive blades. A conductive strip made of a material that bends when subject to a temperature rise is fixed to the first blade and has a free end. A conductive plate is arranged inside the casing and in electrical connection with the second blade and movable between an engaged position where the conductive plate engages the conductive strip to form an electrical connection between the first and second blades and a disengaged position where the conductive plate disengages from the conductive strip to electrically disconnect the second blade from the first blade. When an overload occurs, an excessive current flows through the conductive strip, causing the strip to bend from a normal operation condition to a breaking condition that separates the conductive strip from the conductive plate. A link is coupled to the conductive plate and defines an elongated slot receiving the free end of the conductive strip therein. The elongated slot allows the conductive plate to move between the engaged and disengaged positions without causing movement of the conductive strip while when the condutive strip is in the breaking condition, the link drivingly couples the conductive strip to the conductive plate for returning the conductive strip back to the normal operation condition. A leaf spring is pivoted between the casing and the conductive strip to retain the conductive strip in the breaking condition until the conductive strip is driven by the link back to the normal operation condition.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE INVENTION

Figure 1:
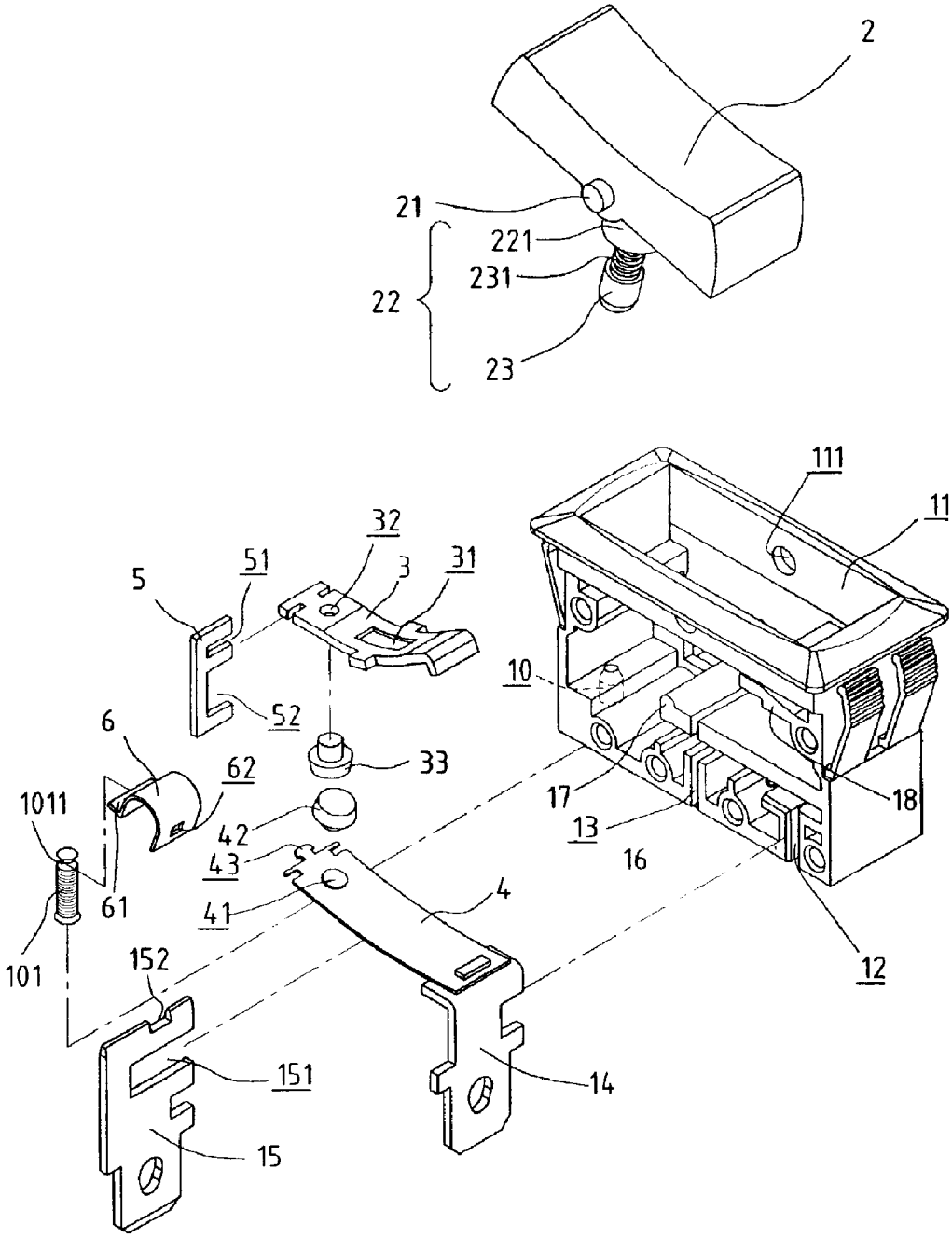
FIG. 1 is an exploded perspective view of a switch constructed in accordance with a first embodiment of the present invention.
Figure 2:
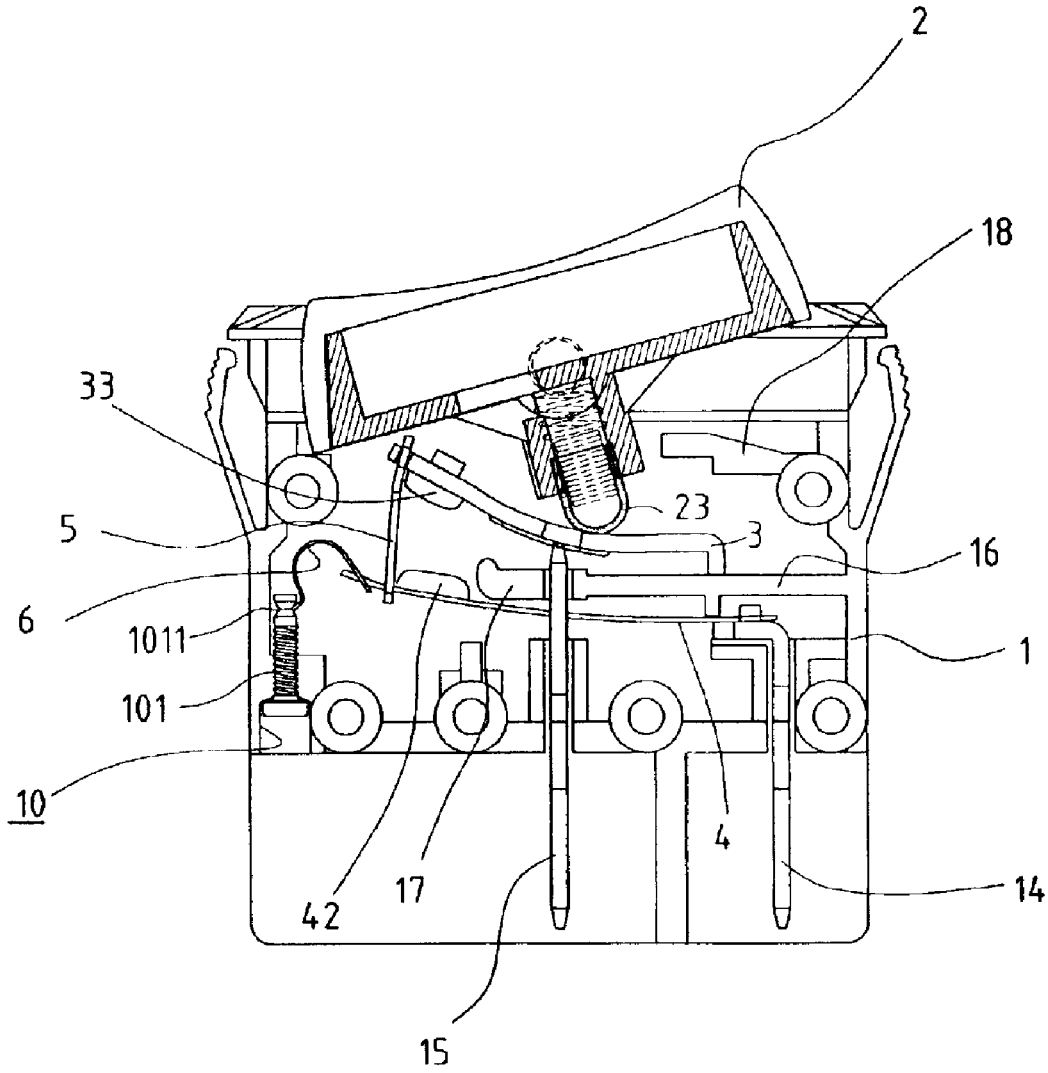
FIG. 2 is a cross-sectional view of the switch in an OFF condition.
Figure 3:
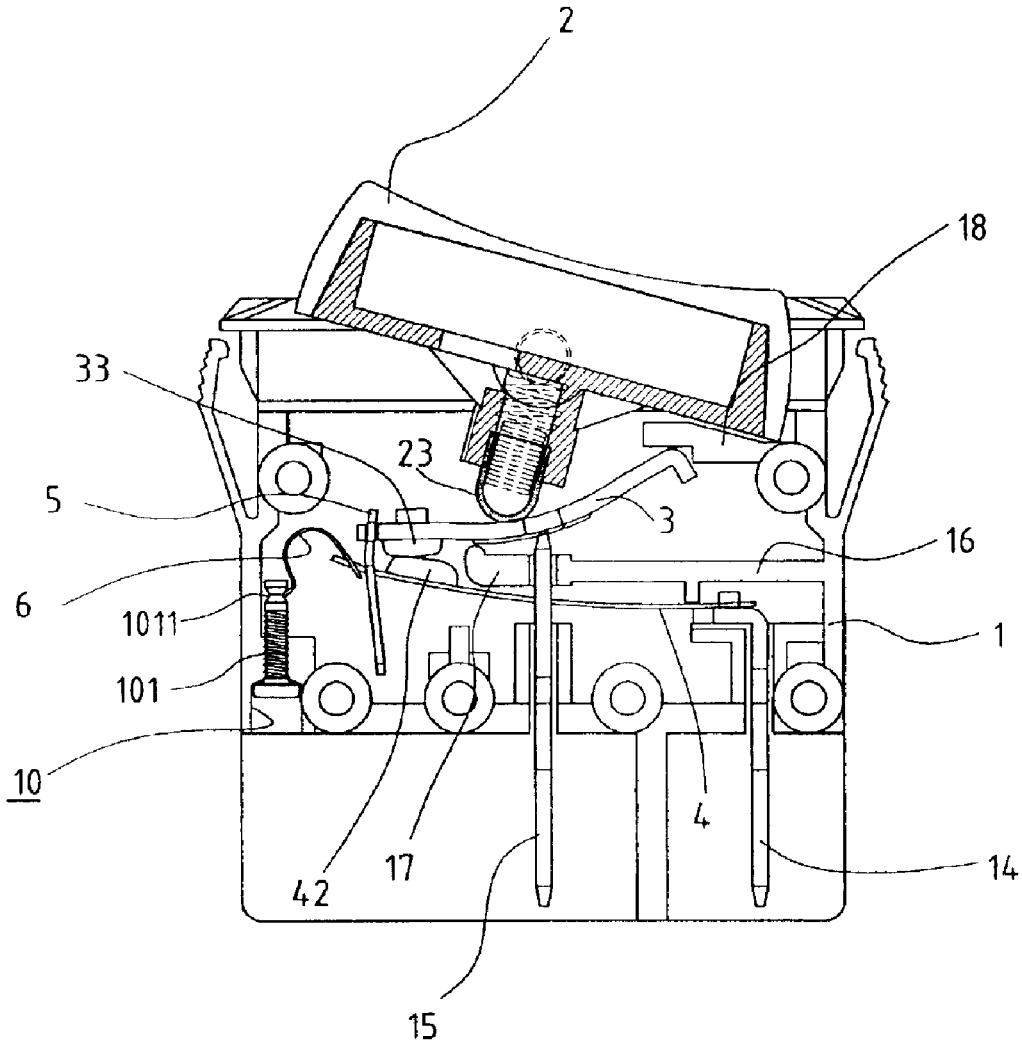
FIG. 3 is a cross-sectional view of the switch in an ON condition.

With reference to the drawings and in particular to FIGS. 1–3, a switch constructed in accordance with the present invention comprises a casing 1 forming an interior space (not labeled) and having opposite side walls (not labeled) defining a top opening 11 in communication with the interior space. Aligned holes 111 are defined in the sidewalls. A rotation button 2 is partially received in the opening 11 and has opposite pivot pins 21 rotatably received in the holes 111 of the casing 1 whereby the button 2 is rotatable between first and second positions respectively associated with ON and OFF conditions of the switch as shown in FIGS. 3 and 2.

A driver assembly 22 is formed on an underside of the button 2 and extends into the interior space of the casing 1. The driver assembly 22 comprises a cylinder 221 extending from the underside of the button 2 inside which a cap 23 is partially and movably received. A biasing element 231, such as a helical spring, is mounted between the cylinder 221 and the cap 23 for biasing the cap 23 away from the cylinder 221. The helical spring 231 is received and retained in both the cylinder 221 and the cap 23.

Two slots 12, 13 are defined in a bottom (not labeled) of the casing 1. First and second conductive blades 14, 15 are fit and fixed in the slots 12, 13 and having tails (not labeled) extending beyond the bottom of the casing 1 for external connection. An opening 151 is defined in the second blade 15. A conductive strip 4 made of a conductive material, such as an alloy or a bimetal, that bends when subject to heat (and thus having a temperature rise) is arranged inside the casing 1 and has an end attached to the first blade 14 and a second, free end extending through the opening 151, forming a cantilever beam. The opening 151 is large enough to accommodate the bending and deformation of the conductive strip 4 without any physical engagement therebetween.

The second blade 15 defines a notch 152 in a top edge (not labeled) thereof. A seesaw plate 3 made of a conductive material is arranged inside the casing 1 and has a concave configuration and forms a bottom projection (not labeled) fit in the notch 152 of the second blade 15 whereby the seesaw plate 3 seesaws about the top edge of the second blade 15. The bottom projection of the seesaw plate 3 is formed by pressing the plate 3 that forms a recess 31 on a top side thereof and the recessed portion of the plate 3 forms the projection. A hole 32 is defined at a first end of the seesaw plate 3 to which a first contact 33 is received and fixed. A second contact 42 is mounted to a hole 41 defined in the conductive strip 4 to correspond to the first contact 33.

The cap 23 of the button 2 engages the top side of the seesaw plate 3 and is slidable along the seesaw plate 3 to seesaw the seesaw plate 3. When the button 2 is rotated to the first position (the ON condition, FIG. 3), the cap 23 is moved to the first end of the seesaw plate 3 close to the first contact 33 whereby the seesaw plate 3 is moved to an engaged position where the first contact 33 is brought into engagement with the second contact 42 of the conductive strip 4. Thus, an electrical connection between the first and second blades 14, 15, through the conductive strip 4, the second and first contacts 42, 33 and the seesaw plate 3, is formed.

When the button 2 is rotated to the second position (the OFF condition, FIG. 2), the cap 23 is moved to a second end of the seesaw plate 3 away from the first contact 33 whereby the seesaw plate 3 is moved to a disengaged position by rotation about the notch 152 of the second blade 15 to separate the first contact 33 from the second contact 42. Thus, the electrical connection between the first and second blades 14, 15 is broken.

In sliding along the seesaw plate 3 between the first and second ends thereof, the cap 23 is forced toward the button 2 when the cap 23 passes the edge of the second blade 15 by deforming the biasing element 231. If desired, the cap 23 may be partially received in the recess 31 defined in the top side of the seesaw plate 3 to be guided thereby.

The rotation of the button 2 between OFF and ON conditions causes the seesaw plate 3 to seesaw between the disengaged and engaged positions. When the seesaw plate 3 is moved to the disengaged position, to ensure correctly positioning of the seesaw plate 3 and to prevent undesired engagement between the seesaw plate 3 and the first blade 14 (noting that the seesaw plate 3 is always in engagement with the second blade 15), a partition 16 is formed inside the casing 1 and extending above the conductive strip 4 and the first blade 14. Thus, when the seesaw plate 3 is moved to the disengaged position, the second end of the seesaw plate 3 is stopped by the partition 16 thereby ensuring the correct positioning of the seesaw plate 3 at the disengaged position.

Similarly, when the seesaw plate 3 is moved to the engaged position, the casing 1 forms a first stop 17 located between the first end of the seesaw plate 3 and the conductive strip 4. When the first contact 33 engages the second contact 42, the first stop 17 engages the seesaw plate 3 and thus fixing the seesaw plate 3 at the engaged position. Overturning of the seesaw plate 3 is prevented. An additional second stop 18 may be formed inside the casing 1 spaced from and substantially opposite to the partition 16 for engaging the second end of the seesaw plate 3 and thus further fixing the seesaw plate 3 at the engaged position.

Figure 4:
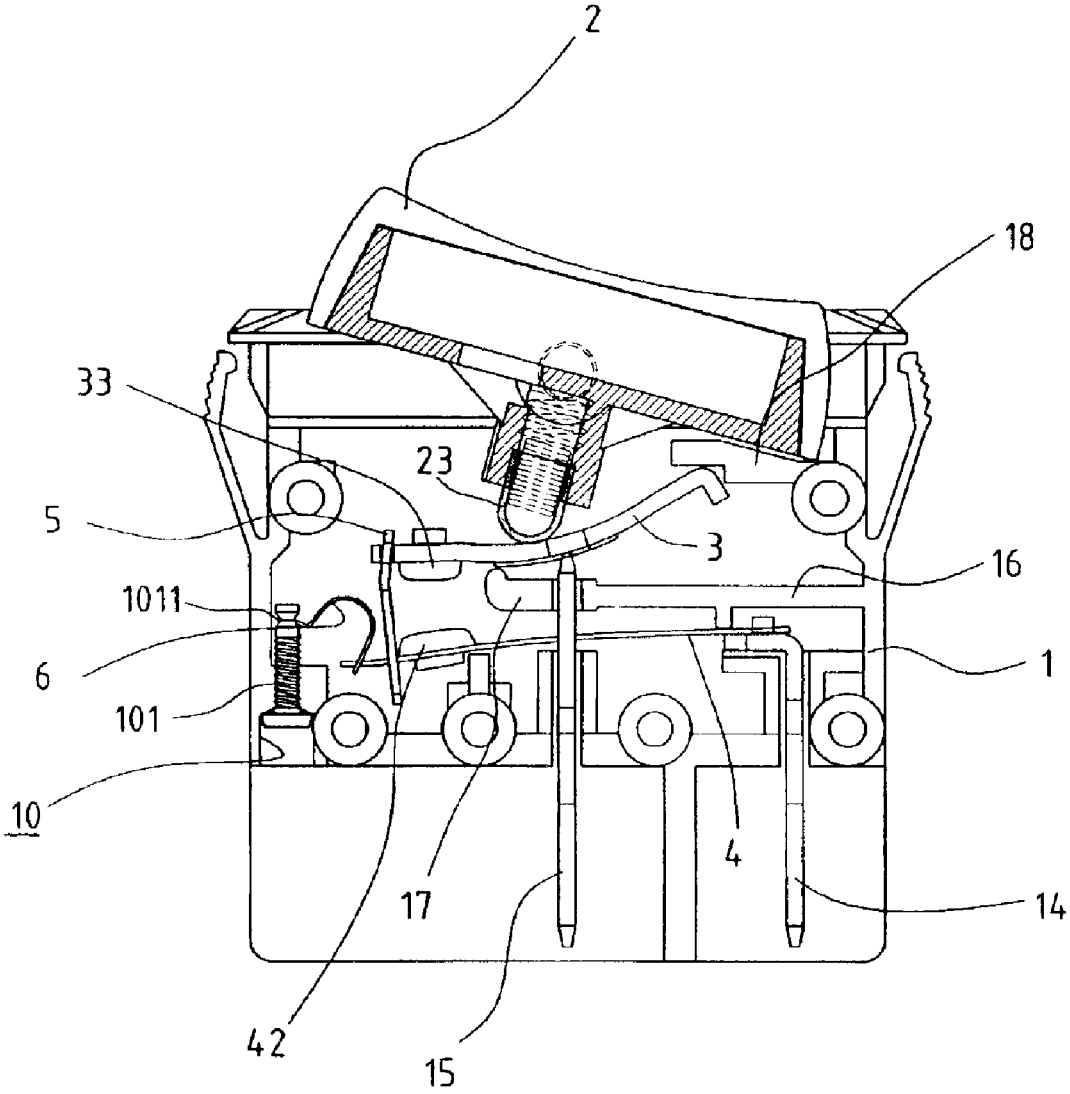
FIG. 4 is a cross-sectional view of the switch in a breaking condition.

Also referring to FIG. 4, when an overload happens, an excessive current flows through the conductive strip 4, causing a significant temperature rise. The conductive strip 4 that is upward concave in the normal operation condition bends in a direction away from the seesaw plate 3 to a downward concave configuration to separate the first and second contacts 33, 42 thereby breaking the electrical connection between the first and second blades 14, 15 and cutting off the current. The stop 17 that is located between the seesaw plate 3 and the conductive strip 4 also functions to prevent the conductive strip 4 from bending toward the seesaw plate 3. Thus, the conductive strip 4 is only allowed to bend, due to temperature rise, in a direction away from the seesaw plate 3 in order to properly disengage the contacts 33, 42.

Preferably, one or more stops are formed inside the casing for preventing over-bending of the conductive strip 4 when the conductive strip 4 is subject to a temperature rise. This is to ensure that the conductive strip 4 does not contact the second blade 15 even when it is subject to a significant temperature rise.

Figure 5:
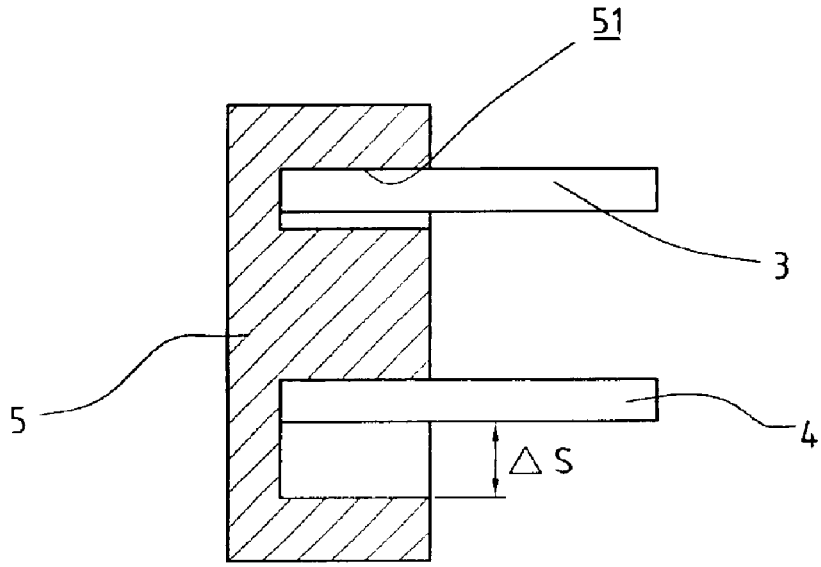
FIG. 5 is a cross-sectional view illustrating a spatial relationship between a link and a seesaw plate and a conductive strip.
Figure 6:
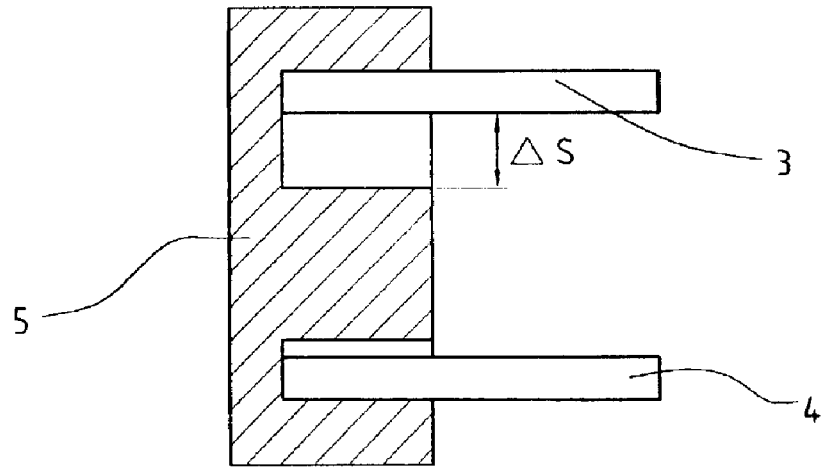
FIG. 6 is a cross-sectional view similar to FIG. 5 but showing a variation thereof.

Referring back to FIG. 1 and further referring to FIGS. 5 and 6, a link 5 made of insulative materials extends in a longitudinal direction between the first end of the seesaw plate 3 and the free end of the conductive strip 4 and is interconnected to the seesaw plate 3 and the conductive strip 4. The link 5 has a first slot 51 and a second slot 52. One of the slots 51, 52 is extended in the longitudinal direction. In the embodiment shown in FIGS. 1 and 5, the second slot 52 is extended. The first end of the seesaw plate 3 is received in the first slot 51 and is thus attached to the link 5 with a limited rotation with respect to the link 5. The free end of the conductive strip 4 is received in the second slot 52 and is movable between an upper end and a lower end (both not labeled) of the second slot 52. When the button 2 is rotated to the first position (the On condition, FIG. 3), the link 5 is moved by the seesaw plate 3 relative to the free end of the conductive strip 4, causing the free end of the conductive strip 4 to engage and be stopped by the upper end of the second slot 52 of the link 5. On the other hand, when the button 2 is rotated to the second position (the OFF condition, FIG. 2), the link 5 is moved by the seesaw plate 3 in an opposite direction, causing the free end of the conductive strip 4 to engage and be stopped by the lower ends of the second slots 52 of the link 5. In this respect, the slot 52 has a longitudinal dimension or a moving distance ($\Delta S$) substantially corresponding to the movement stroke of the first contact 33 that is mounted to the first end of the seesaw plate 3 toward the second contact 42 that is mounted to the free end of the conductive strip 4 whereby no constraint is imposed to the movement of the seesaw plate 3 with respect to the conductive strip 4 by the link 5 during a normal operation.

The dimension of the second slot 52 of the link 5 and the dimension of the opening 151 of the second blade 15 are sized so that when an overload occurs during an ON condition with electrical current supplied through the conductive strip 4, the conductive strip 4 bends away from the seesaw plate 3, the longitudinal dimension of the second slot 52 allows the free end of the conductive strip 4 to move away from the first end of the seesaw plate 3. The movement of the free end of the conductive strip 4 is stopped by the lower end of the second slot 52 of the link 5 and is not allowed to contact the opening 151 of the second blade 15.

To return to the normal operation from the breaking condition, the button 2 is moved to the OFF condition. The seesaw plate 3 is moved to separate the first end thereof from the first stop 17. The free end of the conductive strip 4 is forced to move in unison with the seesaw plate 3 by means of the link 5. Thus, the switch is back to the OFF condition and is ready for next actuation. The button 2 may then be moved to the ON condition to engage the first contact 33 with the second contact 42 for resuming electrical connection between the first and second blades 14, 15.

The link 5 ensures that the free end of the conductive strip 4 can be brought back to its unbent position for next actuation of the switch. Even when the mechanical property of the conductive strip 4 deteriorate due to aging or other reasons, the link 5 still provide means for returning the conductive strip 4 back to its unbent position.

FIG. 6 shows a variation of the example illustrated in FIG. 5. In the variation of FIG. 6, the first slot 51, rather than the second slot 52, of the link 5 is extended in the longitudinal direction. Similarly, due to the longitudinal dimension of the first slot 51, the movement of the conductive strip 4 is not subject to any constraint caused by the link 5 while the link 5 helps bringing the conductive strip 4 from a bent condition (caused by overload of the switch) back to the normal operation condition.

A U-shaped leaf spring 6 has opposite legs of which a first one is pivotally connected to the casing 1 and a second one pivotally coupled to the free end of the conductive strip 4. The second leg of the leaf spring 6 defines an opening 62 and the free end of the conductive strip 4 forms an extension having barbed end 43. The extension 43 is received in the opening 62, forming the pivotal coupling between the conductive strip 4 and the leaf spring 6. The pivotal connection of the first leg of the leaf spring 6 to the casing 1 allows the second leg of the leaf spring 6 to move with the free end of the conductive strip 4 when the conductive strip 4 is moved to the breaking condition due to overload.

The leaf spring 6 is preloaded and applies a force to the free end of the conductive strip 4 in a direction pointing from the pivotal connection of the first leg to the pivotal coupling of the second leg. When the conductive strip 4 is in a normal operation condition, the pivotal coupling of the second leg is located above the pivotal connection of the first leg. The spring force of the leaf spring 6 acts in such a direction to retain the conductive strip 4 in an upward concave condition which leads to the normal operation of the switch. When an overload occurs, the conductive strip 4 bends to a downward concave condition. The movement of the second leg of the leaf spring 6 with the conductive strip 4 moves the pivotal coupling of the second leg to be below the pivotal connection of the first leg whereby the spring force of the leaf spring 6 acts on the free end of the conductive strip 4 in such a direction to retain the conductive strip 4 in the breaking condition.

The spring force of the leaf spring 6 is overcome by a driving force provided by the movement of the link 5 to the conductive strip 4. Thus, the conductive strip 4 can be moved back to the normal operation condition against the leaf spring 6. The leaf spring 6 ensures operation reliability of the conductive strip 4 in both the normal operation condition and the breaking condition.

A bolt 101 is threadingly received in an inner-threaded hole 10 defined in the housing 1. A circumferential groove 1011, preferably having a V-shaped cross section, is defined in a free end of the bolt 101. The U-shaped leaf spring 6 has a flange 61 extending from the first leg of the spring 6 and receivingly engaging the groove 1011 of the bolt 101 for pivotally connecting the first leg of the leaf spring 6 to the casing 1. The pivotal connection of the first leg of the leaf spring 6 inside the casing 1 is position-adjustable by turning the bolt 101 to change relative position of the bolt 101 with respect to the casing 1.

Figure 7:
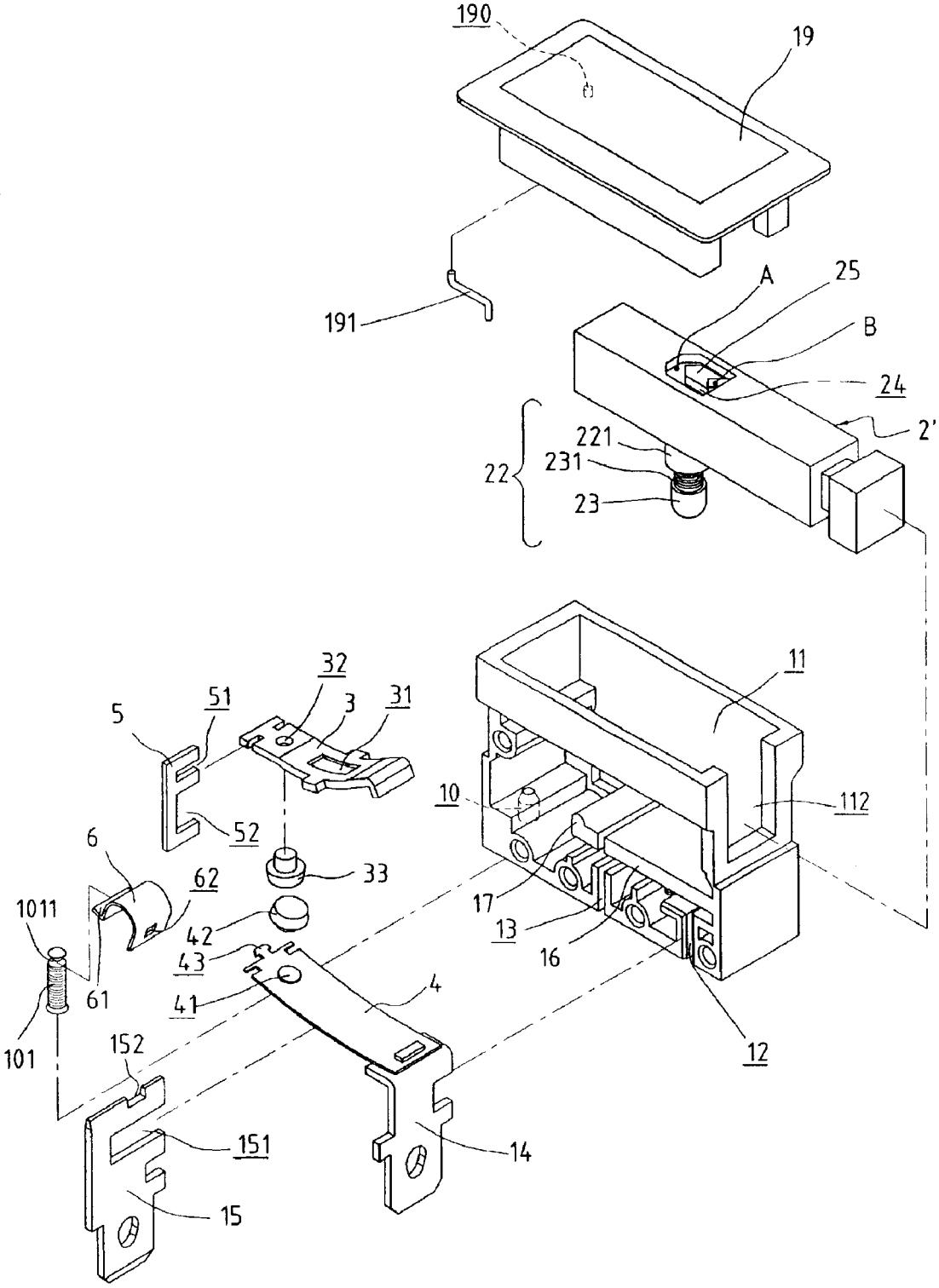
FIG. 7 is an exploded view of a switch constructed in accordance with a second embodiment of the present invention.
Figure 8:
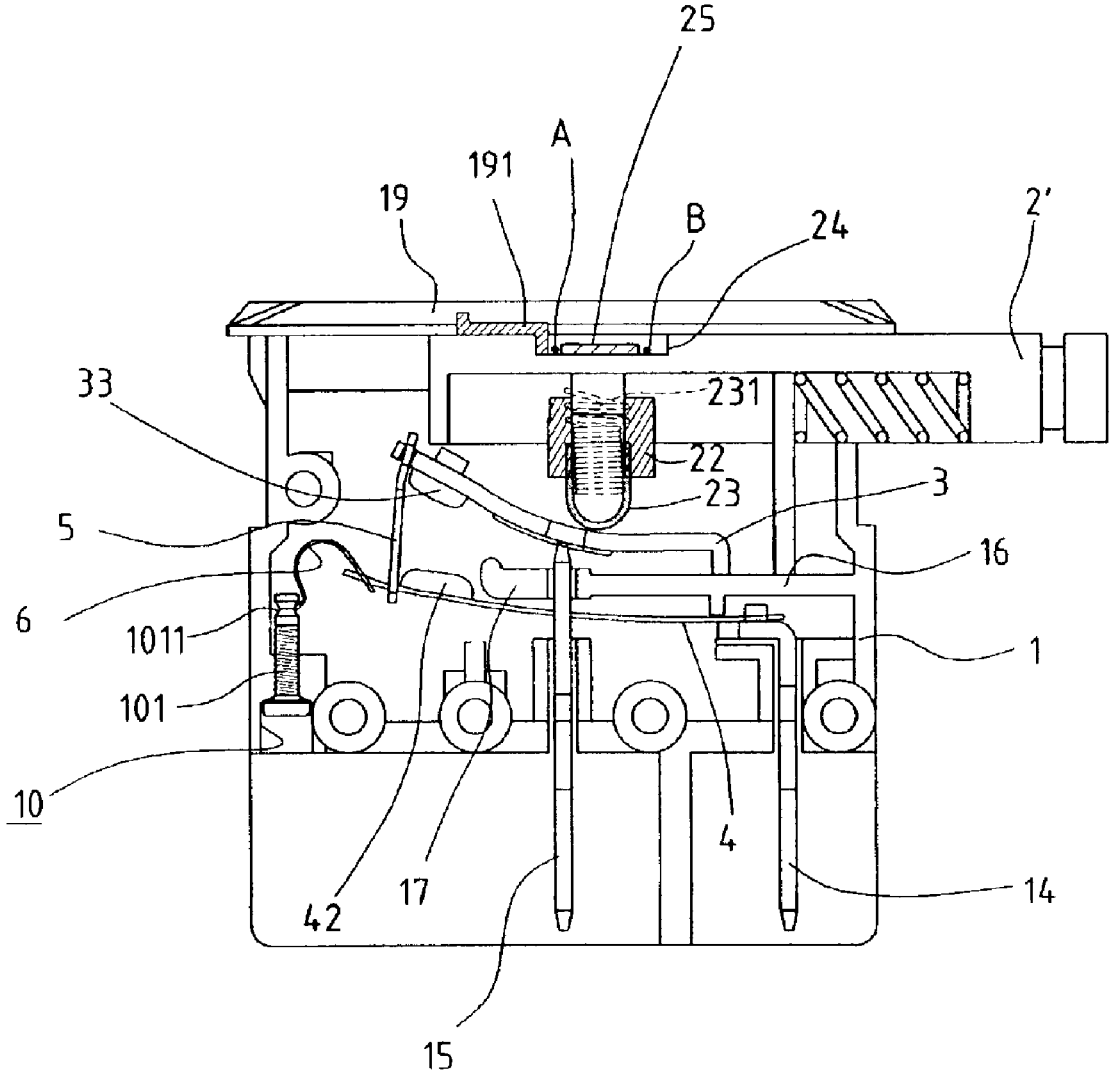
FIG. 8 is a cross-sectional view of the switch in an OFF condition.
Figure 9:
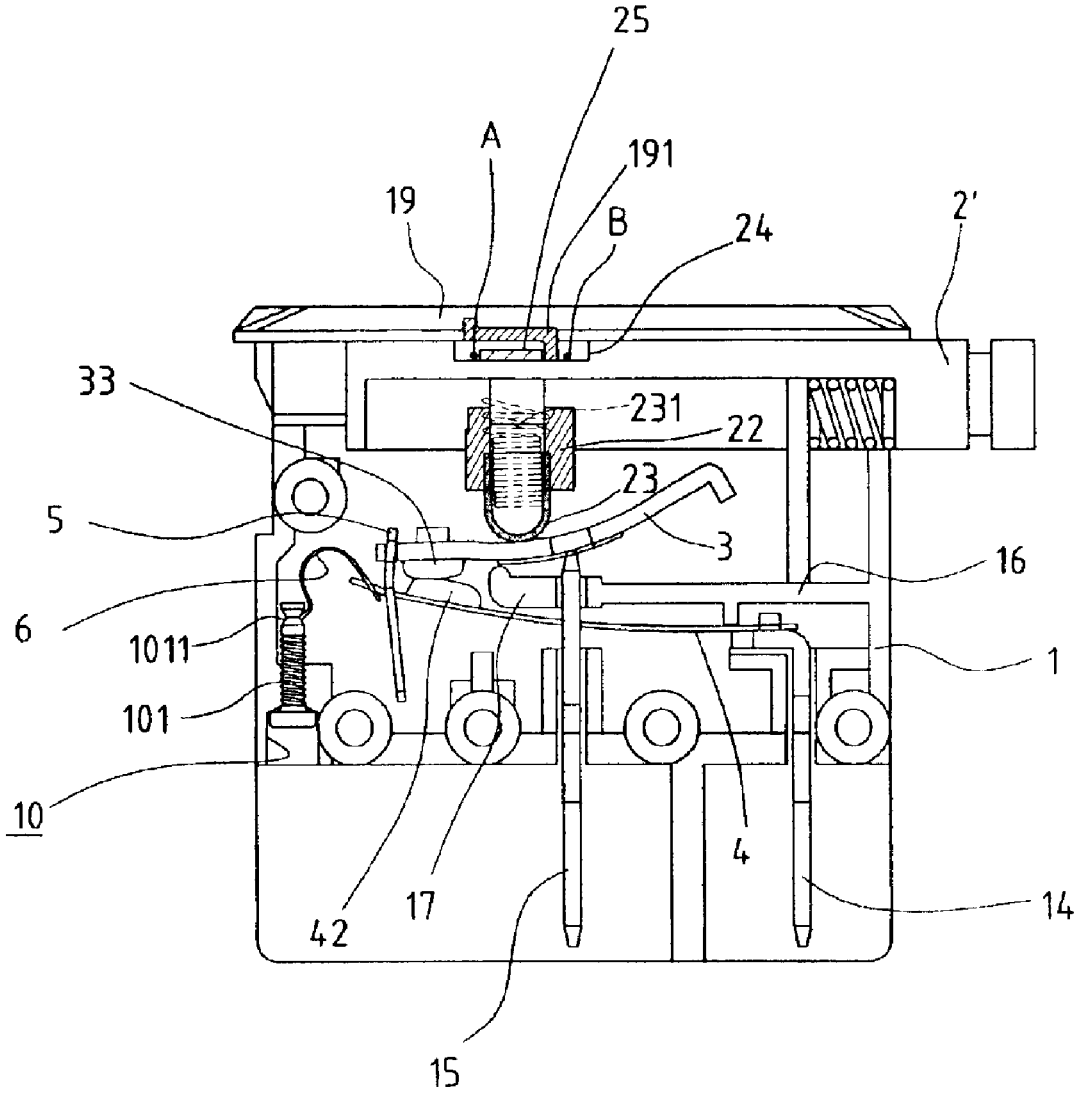
FIG. 9 is a cross-sectional view of the switch in an ON condition.

FIGS. 7–9 show a switch constructed in accordance with a second embodiment of the present invention, comprising a casing 1 forming an interior space (not labeled) and having opposite side walls (not labeled) defining a top opening 11 and a side opening 112 both in communication with the interior space. A cover 19 is fit into the top opening 11 and is fixed to the casing 1. A hole 190 is defined in an inside surface (not labeled) of the cover 19. A Z-shaped bar 191 has a major central section and two minor end sections extending from opposite ends of the central section in opposite directions. An end section of the bar 191 is fit into the hole 190 whereby the bar 191 is attached to the inner surface of the cover 19.

A pushbutton 2' is movably received in the interior space of the casing 1 through the side opening 112. A guide block 25 having a polygonal configuration is formed on a top side of the pushbutton 2' defining a multi-section channel 24 surrounding the block 25. The channel 24 forms a closed loop path or route having stop points A and B. The second end section of the bar 191 is movably received in the channel 24 and is guided to move along the route. The pushbutton 2' is linearly movable with respect to the casing 1 between an outer position (FIG. 8) and an inner position (FIG. 9). By repeatedly pushing the pushbutton 2', the end section of the bar 191 is moved along the channel 24 between the stop points A and B. When the pushbutton 2' is pushed once and moved to the inner position, the end section of the bar 191 is moved to the stop point B and trapped there for retaining the pushbutton 2' at the inner position. When the pushbutton 2' is pushed again and is thus moved to the outer position, the end section of the bar 191 is moved to the stop point A. The outer and inner positions of the pushbutton 2' respectively associated with OFF and ON conditions of the switch as shown in FIGS. 8 and 9. The pushbutton 2' is spring-biased for helping movement between the stop points A and B.

A driver assembly 22 is formed on an underside of the pushbutton 2' and extends into the interior space of the casing 1. The driver assembly 22 comprises a cylinder 221 extending from the underside of the pushbutton 2' inside which a cap 23 is movably received. A biasing element 231, such as a helical spring, is mounted between the cylinder 221 and the cap 23 for biasing the cap 23 away from the cylinder 221. The helical spring 231 is received and retained in both the cylinder 221 and the cap 23.

Two slots 12, 13 are defined in a bottom (not labeled) of the casing 1. First and second conductive plates 14, 15 are fit and fixed in the slots 12, 13 and having tails (not labeled) extending beyond the bottom of the casing 1 for external connection. An opening 151 is defined in the second blade 15. A conductive strip 4 made of a conductive material, such as an alloy and a bimetal, that bends when subject to heat and thus having a temperature rise has an end attached to the first blade 14 and a second, free end extending through the opening 151 forming a cantilever beam. The opening 151 is large enough to accommodate the deformation of the conductive strip 4 without any physical engagement therebetween.

The second blade 15 defines a notch 152 at a top edge (not labeled) thereof. A seesaw plate 3 made of a conductive material has a concave configuration and forms a bottom projection (not labeled) fit in the notch 152 of the second blade 15 whereby the seesaw plate 3 seesaws about the top edge of the second blade 15. The bottom projection of the seesaw plate 3 is formed by pressing the plate 3, which forms a recess 31 on a top side thereof, and the recessed portion of the plate 3 forms the projection. A hole 32 is defined at a first end of the seesaw plate 3 to which a first contact 33 is received and fixed. A second contact 42 is mounted to a hole 41 defined in the conductive strip 4 to correspond to the first contact 33.

The cap 23 of the button 2 engages the top side of the seesaw plate 3 and is slidable along the seesaw plate 3 to seesaw the seesaw plate 3. When the pushbutton 2' is moved to the inner position (the ON condition, FIG. 9), the cap 23 is moved to the first end of the seesaw plate 3 close to the first contact 33 whereby the seesaw plate 3 is driven to an engaged position where the first contact 33 is brought into engagement with the second contact 42 of the conductive strip 4. Thus, an electrical connection between the first and second blades 14, 15, through the conductive strip 4, the second and first contacts 42, 33 and the seesaw plate 3, is formed.

When the pushbutton 2' is moved to the outer position (the OFF condition, FIG. 8). The cap 23 is moved to a second end of the seesaw plate 3 away from the first contact 33 whereby the seesaw plate 3 is driven to a disengaged position by rotation about the notch 152 of the second blade 15 to separate the first contact 33 from the second contact 42. Thus, the electrical connection between the first and second blades 14, 15 is broken.

In sliding along the seesaw plate 3 between the first and second ends thereof, the cap 23 is forced toward the pushbutton 2' when the cap 23 passes the edge of the second blade 15 by deforming the biasing element 231. If desired, the cap 23 may be partially received in the recess 31 defined in the top side of the seesaw plate 3 to be guided thereby.

The movement of the pushbutton 2' between the outer and inner positions (the OFF and ON conditions) causes the seesaw plate 3 to seesaw between the disengaged and engaged positions. When the seesaw plate 3 is moved to the disengaged position, to ensure correctly positioning of the seesaw plate 3 and to prevent undesired engagement between the seesaw plate 3 and the first blade 14 (noting that the seesaw plate 3 is always in engagement with the second blade 15), a partition 16 is formed inside the casing 1 and extending above the conductive strip 4 and the first blade 14. Thus, when the seesaw plate 3 is moved to the disengaged position, the second end of the seesaw plate 3 is stopped by the partition 16 thereby ensuring the correct positioning of the seesaw plate 3 at the disengaged position.

Similarly, when the seesaw plate 3 is moved to the engaged position, the casing 1 forms a stop 17 located between the seesaw plate 3 and the conductive strip 4. When the first contact 33 engages the second contact 42, the stop 17 engages the seesaw plate 3 and thus fixing the seesaw plate 3 at the engaged position. Overturning of the seesaw plate 3 is prevented.

Figure 10:
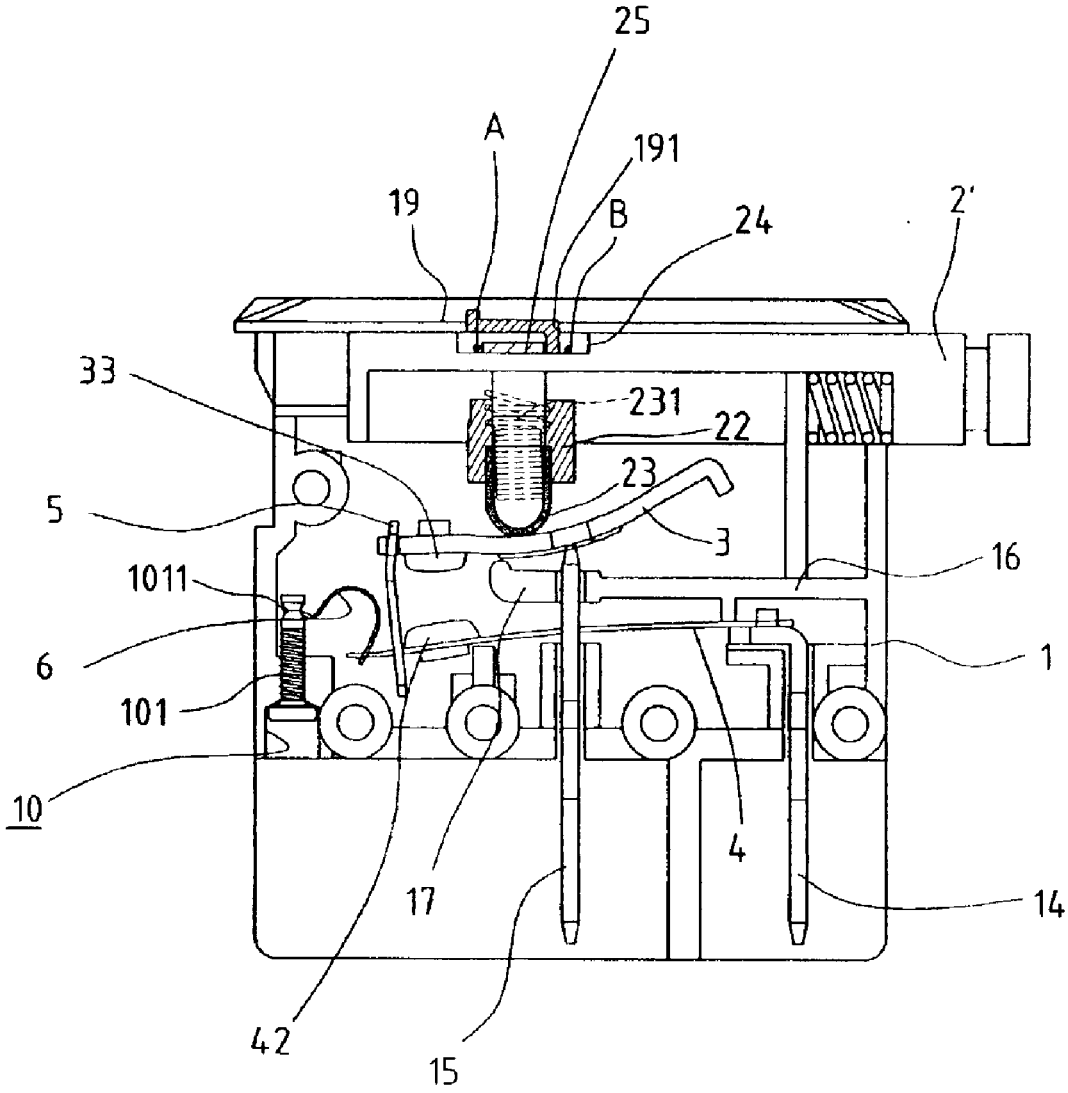
FIG. 10 is a cross-sectional view of the switch in a breaking condition.

Also referring to FIG. 10, when an overload happens, an excessive current flows through the conductive strip 4, causing a significant temperature rise. The conductive strip 4 that is upward concave in the normal operation condition bends in a direction away from the seesaw plate 3 to a downward concave configuration to separate the first and second contacts 33, 42 thereby breaking the electrical connection between the first and second blades 14, 15 and cutting off the current. The stop 17 that is located between the seesaw plate 3 and the conductive strip 4 also functions to prevent the conductive strip 4 from bending toward the seesaw plate 3. Thus, the conductive strip 4 is only allowed to bend, due to temperature rise, in a direction away from the seesaw plate 3 in order to properly disengage the contacts 33, 42.

Referring back to FIG. 7, a link 5 made of insulative materials extends in a longitudinal direction between the first end of the seesaw plate 3 and the free end of the conductive strip 4 and is interconnected to the seesaw plate 3 and the conductive strip 4. The link 5 has a first slot 51 and a second slot 52. One of the slots 51, 52 is extended in the longitudinal direction. In the embodiment shown in FIGS. 7–9, the second slot 52 is extended and has a predetermined longitudinal dimension defined by upper and lower ends (both not labeled). The first end of the seesaw plate 3 is received in the first slot 51 and is thus attached to the link 5 with a limited rotation with respect to the link 5. The free end of the conductive strip 4 is received in the second slot 52 and is movable between the upper and lower ends of the second slot 52. When the pushbutton 2' is moved to the inner position (the On condition, FIG. 9), the link 5 is moved by the seesaw plate 3 relative to the free end of the conductive strip 4, causing the free end of the conductive strip 4 to engage the upper end of the second slot 52 of the link 5. On the other hand, when the pushbutton 2' is moved to the outer position (the OFF condition, FIG. 8), the link 5 is moved by the seesaw plate 3 in an opposite direction, causing the free end of the conductive strip 4 to engage the lower ends of the second slots 52 of the link 5. In this respect, the slot 52 has a longitudinal dimension or a moving distance substantially corresponding to the movement stroke of the first contact 33 that is mounted to the first end of the seesaw plate 3 toward the second contact 42 that is mounted to the free end of the conductive strip 4 whereby no constraint is imposed to the movement of the seesaw plate 3 with respect to the conductive strip 4 by the link 5 during a normal operation.

The dimension of the second slot 52 of the link 5 and the dimension of the opening 151 of the second blade 15 are sized so that when an overload occurs during an ON condition with electrical current supplied through the conductive strip 4, the conductive strip 4 bends away from the seesaw plate 3, the longitudinal dimension of the second slot 52 allows the free end of the conductive strip 4 to move away from the first end of the seesaw plate 3. The movement of the free end of the conductive strip 4 is stopped by the lower end of the second slot 52 of the link 5 and is not allowed to contact the opening 151 of the second blade 15.

To return to the normal operation from the breaking condition, the pushbutton 2' is moved to the outer position (the OFF condition). The seesaw plate 3 is moved to separate the first end thereof from the first stop 17. The free end of the conductive strip 4 is forced to move in unison with the seesaw plate 3 by means of the link 5. Thus, the switch is back to the OFF condition and is ready for next actuation. The pushbutton 2' may then be moved to the inner position (the ON condition) to engage the first contact 33 with the second contact 42 for resuming electrical connection between the first and second blades 14, 15.

A U-shaped leaf spring 6 has opposite legs of which a first one is pivotally connected to the casing 1 and a second one pivotally coupled to the free end of the conductive strip 4. The second leg of the leaf spring 6 defines an opening 62 and the free end of the conductive strip 4 forms an extension having barbed end 43. The extension 43 is received in the opening 62, forming the pivotal coupling between the conductive strip 4 and the leaf spring 6. The pivotal connection of the first leg of the leaf spring 6 to the casing 1 allows the second leg of the leaf spring 6 to move with the free end of the conductive strip 4 when the conductive strip 4 is moved to the breaking condition due to overload.

The leaf spring 6 is preloaded and applies a force to the free end of the conductive strip 4 in a direction pointing from the pivotal connection of the first leg to the pivotal coupling of the second leg. When the conductive strip 4 is in a normal operation condition, the pivotal coupling of the second leg is located above the pivotal connection of the first leg. The spring force of the leaf spring 6 acts in such a direction to retain the conductive strip 4 in the upward concave condition which leads to the normal operation of the switch. When an overload occurs, the conductive strip 4 bends to the downward concave condition. The movement of the second leg of the leaf spring 6 with the conductive strip 4 moves the pivotal coupling of the second leg to be below the pivotal connection of the first leg whereby the spring force of the leaf spring 6 acts on the free end of the conductive strip 4 in such a direction to retain the conductive strip 4 in the breaking condition.

The spring force of the leaf spring 6 is overcome by a driving force provided by the movement of the link 5 to the conductive strip 4. Thus, the conductive strip 4 can be moved back to the normal operation condition against the leaf spring 6. The leaf spring 6 ensures operation reliability of the conductive strip 4 in both the normal operation condition and the breaking condition.

A bolt 101 is threadingly received in an inner-threaded hole 10 defined in the housing 1. A circumferential groove 1011, preferably having a V-shaped cross section, is defined in a free end of the bolt 101. The U-shaped leaf spring 6 has a flange 61 extending from the first leg of the spring 6 and receivingly engaging the groove 1011 of the bolt 101 for pivotally connecting the first leg of the leaf spring 6 to the casing 1. The pivotal connection of the first leg of the leaf spring 6 inside the casing 1 is position-adjustable by turning the bolt 101 to change relative position of the bolt 101 with respect to the casing 1.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A switch comprising:

a casing defining an interior space and having a bottom;

first and second conductive blades arranged in the interior space and mounted to the bottom, the first and second blades having tails extending beyond the bottom for external connection;

a conductive strip made of a material that bends from a normal operation condition to a breaking condition when subject to a temperature rise, the strip having an end fixed to the first blade and an opposite, free end;

a conductive seesaw plate rotatably supported in the casing and in electrical connection with the second blade, the seesaw plate being rotatable between engaged position where a first end of the seesaw plate engages the free end of the conductive strip thereby forming an electrical connection between the first and second blades and a disengaged position where the first end of the seesaw plate disengages from the conductive strip thereby electrically disconnecting the second blade from the first blade;

wherein with the conductive strip at the normal operation condition and the seesaw plate at the engaged position, when an excessive current flows through the conductive strip, the temperature of the conductive strip rises, causing the conductive strip to bend to the breaking condition and breaking the electrical connection between the first and second blades; and a link coupled between the conductive strip and the seesaw plate, the link being configured to impose no constraint to both the conductive strip and the seesaw plate when the conductive strip is in the normal operation condition and also allowing the conductive strip to bend freely to the breaking condition;

wherein with the conductive strip in the breaking condition, when the seesaw plate is moved to the disengaged position, the link drives the conductive strip to move in unison with the seesaw plate to the normal operation condition.

2. The switch as claimed in claim 1, wherein the link is coupled to the first end of the seesaw plate and forms an elongated slot having a predetermined longitudinal dimension defined by upper and lower ends of the elongated slot, the free end of the conductive strip being received in the elongated slot and being allowed to move with respect to the elongated slot, the longitudinal dimension being such that when the first end of the seesaw plate moves between the engaged and disengaged positions, the free end of the conductive strip does not engage the upper and lower ends of the elongated slot and is thus not caused to move by the link and such that with the conductive strip in the breaking condition, when the seesaw plate moves from the engaged position to the disengaged position, the free end of the conductive strip engages and is driven by the lower end of the elongated slot to move back to the normal operation condition.

3. The switch as claimed in claim 1, wherein the link is coupled to the free end of the conductive plate and forms an elongated slot having a predetermined longitudinal dimension defined by upper and lower ends of the elongated slot, the first end of the seesaw plate being received in the elongated slot and being allowed to move with respect to the elongated slot, the longitudinal dimension being such that when the first end of the seesaw plate moves between the engaged and disengaged positions, the first end of the seesaw plate does not engage the upper and lower ends of the elongated slot and the conductive strip is not caused to move by the link and such that with the conductive strip in the breaking condition, when the seesaw plate moves from the engaged position to the disengaged position, the first end of the seesaw plate engages the upper end of the slot and drives the link to move the free end of the conductive strip back to the normal operation condition.

4. The switch as claimed in claim 1, further comprising a biasing element having a first end pivotally connected to the casing and a second end coupled to the free end of the conductive strip, the biasing element applying a retention force to retain the conductive strip in the breaking condition.

5. The switch as claimed in claim 4, wherein the biasing element comprises a U-shaped leaf spring having a first leg pivotally connected to the casing and a second end coupled to the free end of the conductive strip.

6. The switch as claimed in claim 5, wherein the leaf spring is configured to have the coupling between the second leg and the conductive strip movable between opposite sides of the pivotal connection of the first leg to the casing when the conductive strip is moved between the normal operation condition and the breaking condition.

7. The switch as claimed in claim 4, wherein a notch is defined in the casing and wherein the first leg of the leaf spring has a flange receivingly engaging the notch to pivotally connect the first leg to the casing.

8. The switch as claimed in claim 7 further comprising a bolt threadingly received in an inner-threaded hole of the casing, and wherein the notch comprising a groove defined in the bolt.

9. The switch as claimed in claim 8, wherein the groove of the bolt is position-adjustable with respect to the casing by turning the bolt with respect to the casing.

10. The switch as claimed in claim 1, wherein the second blade has a top edge defining a notch and wherein the seesaw plate has a bottom side forming a projection rotatably received in the notch of the second blade thereby forming the electrical connection between the seesaw plate and the second blade and rotatably supporting the seesaw plate in the casing.

11. The switch as claimed in claim 1, wherein the casing forms a top opening defined by opposite side walls and in communication with the interior space and wherein the switch further comprises a control button in driving engagement with the seesaw plate, the control button forming pivot pins rotatably received in holes defined in side walls of the top opening of the casing for rotatably mounting the control button to the casing whereby the control button is rotatable between first and second positions for driving the seesaw plate between engaged and disengaged positions.

12. The switch as claimed in claim 1, wherein the casing defines a top opening and a side opening in communication with the top opening and the interior space of the casing, and wherein the switch further comprises a control button received in the casing through the side opening and in driving engagement with the seesaw plate, the control button being movable with respect to the casing between first and second positions to drive the seesaw plate between the engaged and disengaged positions, a cover fit to the top opening, a control bar mounted to the cover and extending into a channel defined in a top side of the control button, the movement of the control button with respect to the casing being guided by the bar that moves along the channel between two stop points respectively corresponding to the first and second positions.

13. The switch as claimed in claim 12, wherein the channel forms a closed loop path for the bar whereby when the control button is actuated once, the bar moving with respect to the control button from a first stop point to a second stop point and when the control button is actuated second time, the bar moving from the second stop point back to the first stop point.

14. The switch as claimed in claim 13, wherein the control button is spring biased for returning from the second stop point back to the first stop point.

15. A switch comprising:

a casing defining an interior space;

first and second conductive blades arranged in the interior space;

a conductive strip made of a material that bends from a normal operation condition to a breaking condition when subject to a temperature rise, the strip having an end fixed to the first blade and an opposite, free end;

a conductive member movably supported in the casing and in electrical connection with the second blade, the conductive member being movable between engaged position where the conductive member engages the free end of the conductive strip thereby forming an electrical connection between the first and second blades and a disengaged position where the conductive member disengages from the conductive strip thereby electrically disconnecting the second blade from the first blade;

a biasing element having a first end pivotally connected to the casing and a second end coupled to the free end of the conductive strip for applying a biasing force to retain the conductive strip in the breaking condition;

wherein the coupling between the conductive strip and the second end of the biasing element is moved between opposite sides of the pivotal connection of the first end of the biasing element with the casing when the conductive strip is moved between the normal operation condition and the breaking condition.

16. The switch as claimed in claim 15, wherein the biasing element comprises a U-shaped leaf spring having a first leg pivotally connected to the casing and a second leg coupled to the free end of the conductive strip.

17. The switch as claimed in claim 16, wherein a notch is defined in the casing and wherein the first leg of the leaf spring has a flange receivingly engaging the notch to pivotally connect the first leg to the casing.

18. The switch as claimed in claim 17 further comprising a bolt threadingly received in an inner-threaded hole of the casing, and wherein the notch comprises a groove defined in the bolt.

19. The switch as claimed in claim 18, wherein the groove of the bolt is position-adjustable with respect to the casing by turning the bolt with respect to the casing.

* * * * *